United States Patent [19]

Ogawa et al.

[11] Patent Number: 4,522,168

[45] Date of Patent: Jun. 11, 1985

[54] METHOD AND APPARATUS FOR CONTROLLING FUEL-INJECTION AMOUNT IN DIESEL ENGINE

[75] Inventors: Toshihisa Ogawa, Susono; Hideo Miyagi, Okazaki; Masaomi Nagase; Kiyotaka Matsuno, both of Toyota, all of Japan

[73] Assignee: Toyota Jidosha Kabushiki Kaisha, Toyota, Japan

[21] Appl. No.: 513,293

[22] Filed: Jul. 13, 1983

[30] Foreign Application Priority Data

Jan. 31, 1983 [JP] Japan ..... 58-013910

[51] Int. Cl.[3] ..... F02M 39/00

[52] U.S. Cl. ..... 123/198 D; 123/179 L; 123/357

[58] Field of Search ..... 123/357, 198 D, 198 DB, 123/449, 494, 179 L; 73/119 A

[56] References Cited

U.S. PATENT DOCUMENTS

| | | | |
|---|---|---|---|
| 3,602,207 | 8/1971 | Kilmer | 123/198 D |
| 3,867,919 | 2/1975 | Grenier | 123/198 D |
| 3,914,735 | 10/1975 | Guillaume | 123/198 D |
| 4,023,358 | 5/1977 | Maurer | 123/198 D |
| 4,144,862 | 3/1979 | Estrowski | 123/198 D |
| 4,192,279 | 3/1980 | Maisch | 123/198 DB |
| 4,371,050 | 2/1983 | Ikeura | 123/198 DB |
| 4,404,939 | 9/1983 | Kinzl | 123/198 DB |
| 4,421,082 | 12/1983 | Katayose | 123/198 DB |
| 4,426,969 | 1/1984 | Eheim | 123/198 DB |
| 4,429,670 | 2/1984 | Ulanet | 123/198 DB |

*Primary Examiner*—Carl Stuart Miller

*Attorney, Agent, or Firm*—Cushman, Darby & Cushman

[57] ABSTRACT

In a diesel engine having a rotational angle sensor for detecting the engine speed, when the rotational angle sensor is in an abnormal state, a fuel-cutting operation is performed. A first fuel-cutting operation is immediately performed so as to indicate to the driver that an abnormal state exists. However, subsequent fuel-cutting operations after restarting of the engine are delayed as compared with the first fuel-cutting operation.

4 Claims, 7 Drawing Figures

METHOD AND APPARATUS FOR CONTROLLING FUEL-INJECTION AMOUNT IN DIESEL ENGINE

BACKGROUND OF THE INVENTION

1. Field of the Invention

The present invention relates to a method and apparatus for controlling the fuel-injection amount in a diesel engine in which a fuel-cutting operation is performed when a rotational angle sensor for detecting the engine speed is in an abnormal state.

2. Description of the Prior Art

Generally, in a diesel engine, the fuel-injection amount is calculated basically dependent upon the engine speed and the accelerator opening. However, when the rotational angle sensor for detecting the engine speed is in an abnormal state, the fuel-injection amount is calculated basically dependent upon only the accelerator opening. In addition to this, when the vehicle speed is in the vicinity of 0 and the accelerator opening is in the vicinity of 0, a predetermined delay time period, such as 1 msec, elapses so that a fuel-cutting operation is performed, thereby indicating to the driver that the rotational angle sensor is in an abnormal state.

In the above-mentioned prior art, however, if the delay time period for the fuel-cutting operation is set to be relatively short, stalling of the engine may often occur even after the engine has been restarted. In such a case, therefore, if the engine stalls when the vehicle is temporarily stopped at an intersection, it is difficult to move the vehicle to the shoulder of the road. On the contrary, if the delay time period for the fuel-cutting operation is set to be relatively long, even when the driver, who is unaware of the fuel-injection-amount control when the rotational angle sensor is in an abnormal state, lets up on the accelerator, the fuel-injection amount when the rotational angle sensor is in an abnormal state may be larger than the fuel-injection amount when the vehicle is in a conventional idle state, thereby increasing the vehicle speed beyond expectation, which is a disadvantage.

SUMMARY OF THE INVENTION

It is an object of the present invention to provide a method and apparatus for controlling the fuel-injection amount in a diesel engine in which a first fuel-cutting operation due to the rotational angle sensor being in an abnormal state is immediately performed and this abnormal state is indicated to the driver while subsequent fuel-cutting operations after the restarting of the engine are delayed so as to avoid stalling of the engine and to enable the vehicle to be easily moved to the shoulder of the road on the sideway.

BRIEF DESCRIPTION OF THE DRAWINGS

The present invention will be more clearly understood from the description as set forth below with reference to the accompanying drawings; wherein.

DESCRIPTION OF THE PREFERRED EMBODIMENT

Figure 1:
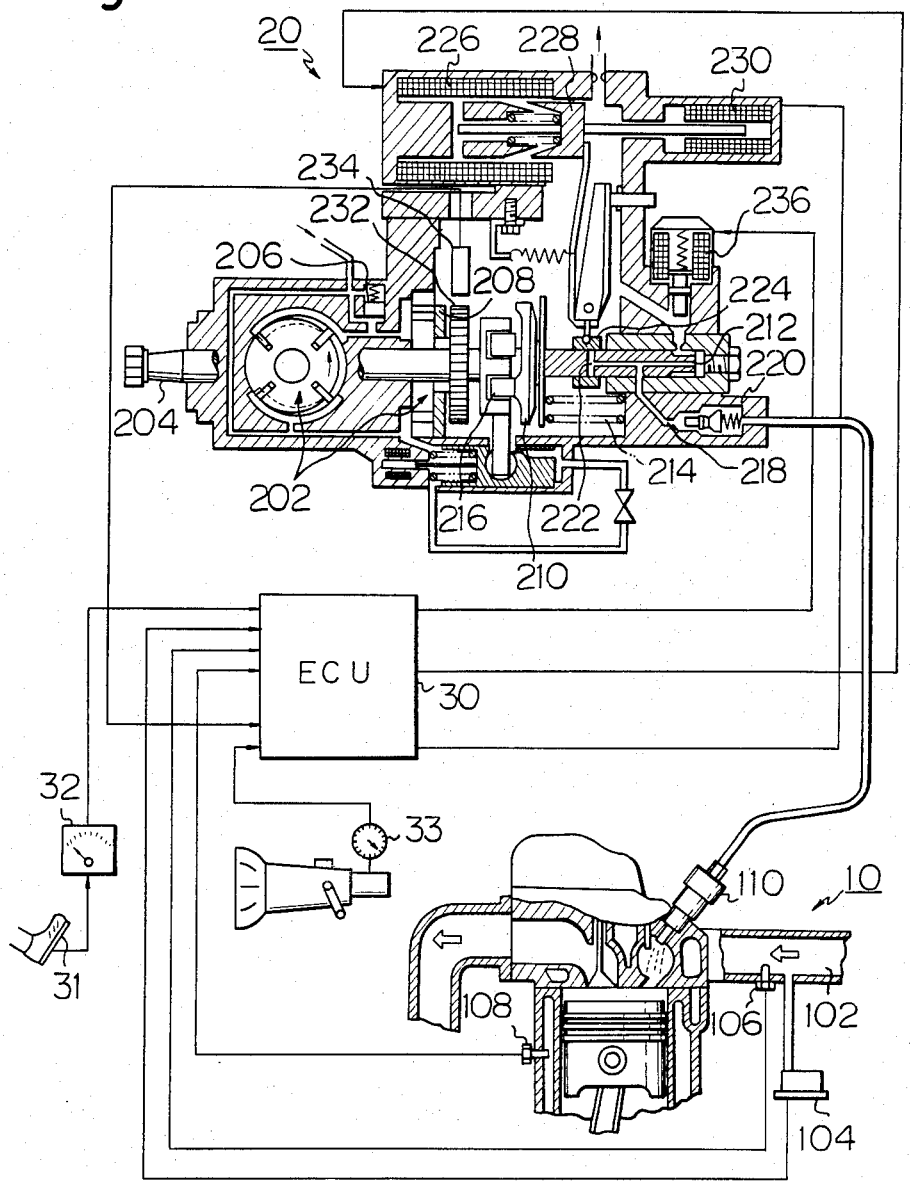
FIG. 1 is a schematic view of a diesel engine and a fuel-injection pump according to the present invention.

In FIG. 1, reference numeral 10 designates a diesel engine, 20 designates a distributor-type fuel-injection pump, and 30 designates a control circuit for controlling the engine 10 and the fuel-injection pump 20. The control circuit 30 may be comprised, for example, of a so-called electric-control unit-(ECU) type of microcomputer.

Disclosed in an intake-air passage 102 is an intake-air-pressure sensor 104 which generates an analog voltage signal corresponding to the absolute pressure within the intake-air passage 102. Also disposed in the intake-air passage 102 is a potentiometer type of intake-air-temperature sensor 106 for generating an analog voltage signal corresponding to the intake-air temperature. Also disposed in the jacket of the cylinder block of the engine 10 is a coolant-temperature sensor 108 for generating an analog voltage signal corresponding to the coolant temperature.

Provided in the prechamber of the engine 10 is a fuel-injection nozzle 110 for supplying compressed fuel from the fuel-injection pump 20 into the respective intake-air port.

The fuel-injection pump 20 comprises a centrifugal type (vane type) of fuel pump 202 coupled to a drive shaft 204 of the engine 10. The fuel pump 202 sucks up a predetermined amount of fuel from the fuel tank (not shown) at every rotation of the drive shaft 204. The fuel pressure of the fuel pump 202 is adjusted by a pressure-regulating valve 206 so that the pressure of the fuel supplied via a hole at the upper side of a feed-pump cover 208 into the pump chamber is proportional to the rotational speed of the drive shaft 204, i.e., to the engine speed. Note that, in FIG. 1, the cross-sectional view on the left side indicated by reference numeral 202 is viewed on a 90° rotated plane.

The drive shaft 204 drives a cam plate 210 and a pump plunger 212, as well as the feed pump 202. The cam plate 210 and the pump plunger 212 are pushed onto a fixed roller 216 by a plunger spring 214. When the cam plate 210 is rotated so that the cam face thereof rides on the rollers 216, the pump plunger 212 performs a predetermined stroke action. Since the pump plunger 212 simultaneously performs a rotary action, the fuel is sucked and is compressed and delivered. Delivery of the compressed fuel is started by the rise of the pump plunger 212, and the fuel is supplied via a distributive passage 218 and a delivery valve 220 to a fuel-injection nozzle 110. Delivery of the compressed fuel is terminated when the pump plunger 212 rises further so that the spill port 222 thereof is opened at the right portion of a spill ring 224.

The fuel-injection amount is controlled by changing the duty ratio of a rectangular pulse applied to a spill-control solenoid (linear solenoid) 226 to move a plunger 228, i.e., to move the spill ring 222. In this case, the position of the spill ring 222 is detected by a spill-ring-position sensor 230 which transmits a detection signal to the control circuit 30, thereby achieving precise control of the fuel-injection amount.

Provided in a gear 232 coupled to the drive shaft 204 is a rotational angle sensor 234 comprised of an electromagnetic pickup which generates a pulse-shaped signal having a frequency proportional to the engine speed.

Reference numeral 236 designates a fuel-cutting valve for switching on and off the amount of fuel injected into the chamber of the plunger 228. In addition, reference numeral 31 designates an accelerator, 32 designates an accelerator-opening sensor, and 33 designates a vehicle-speed sensor.

Figure 2:
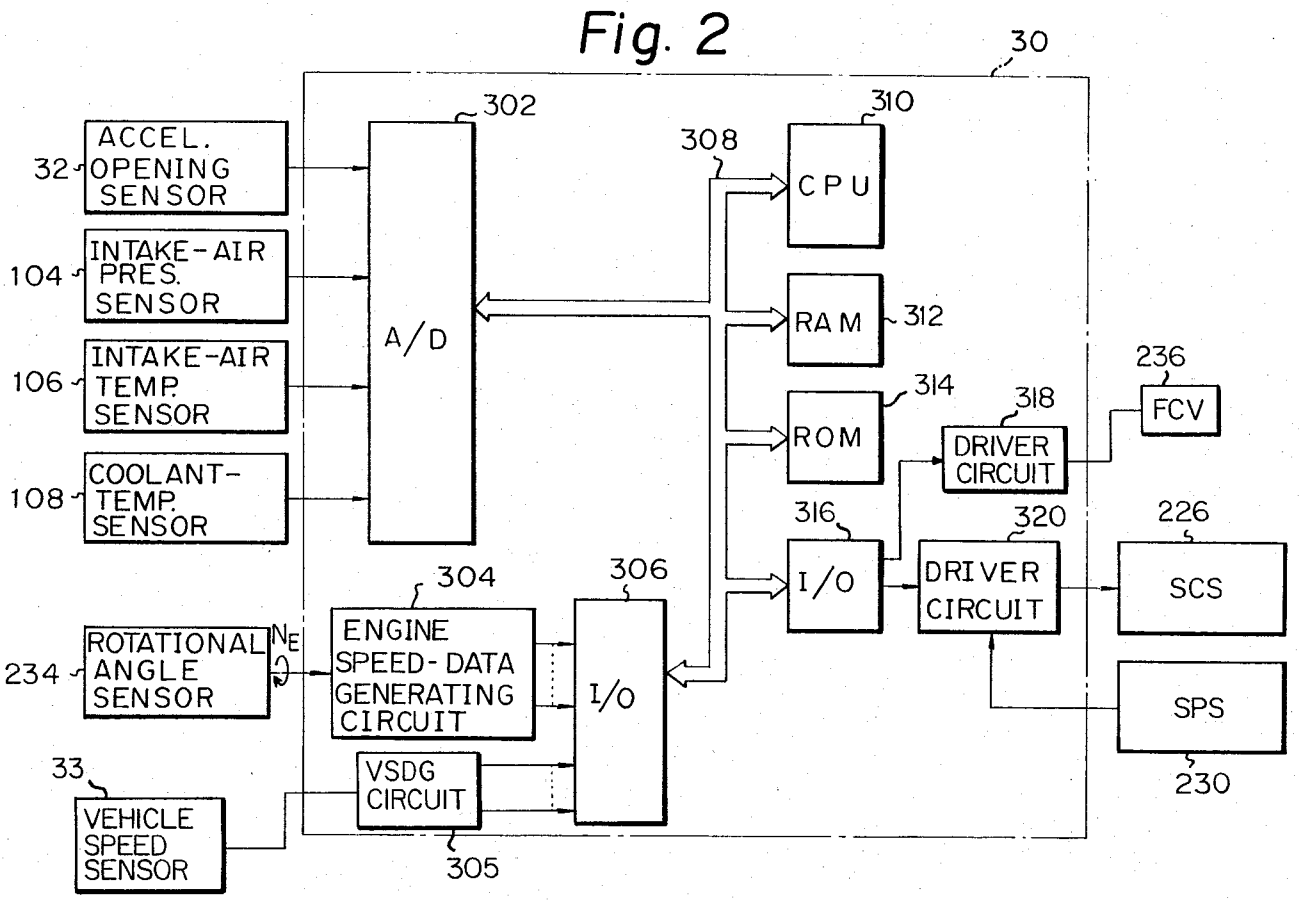
FIG. 2 is a block diagram of the control circuit of FIG. 1.

The control circuit 30 of FIG. 1 is explained with reference to FIG. 2. In FIG. 2, each analog signal of the accelerator-opening sensor 32, the intake-air-pressure sensor 104, the intake-air-temperature sensor 106, and the coolant-temperature sensor 108 is supplied to an analog/digital (A/D) converter 302 incorporating a multiplexer so that each analog signal is sequentially converted into a digital signal. The pulse-shaped signal of the rotational angle sensor 234 is supplied to an engine-speed data-generating circuit 304 which generates a binary-code signal inversely proportional to the engine speed. The binary-code signal is transmitted to a predetermined position of an input/output interface 306. In addition, the pulse-shaped output signal of the vehicle-speed sensor 33 is supplied via a vehicle-speed data-generating circuit 305 to predetermined positions of the input/output interface 306. This vehicle-speed data-generating circuit 305 generates a binary-code signal inversely proportional to the vehicle speed.

The A/D converter 302 and the input/output interface 306 are connected, via a common bus 308, to a central processing unit (CPU) 310, a random-access memory (RAM) 312, a read-only memory (ROM) 314, and an input/output interface 316.

The RAM 312 stores temporary data, and the ROM 314 stores programs such as the main routine, the fuel-injection-amount calculating routine, the fuel-injection-timing calculating routine, and fixed data such as constants and map data.

Connected to the input/output interface 316 is a driver circuit 318 which drives the fuel-cutting valve 236. Also connected to the input/output interface 316 is a driver circuit 320 including a servo-amplifier for driving the spill-control solenoid 226. When duty ratio (pulse duration) data is transmitted by the CPU 310, via the input/output interface 316, to the driver circuit 320, the position of the plunger 212 is detected by the spill-ring-position sensor 230 and is fed back to the driver circuit 320.

The operation of the control circuit of FIG. 1 is now explained with reference to FIGS. 3 and 4.

Figure 3:
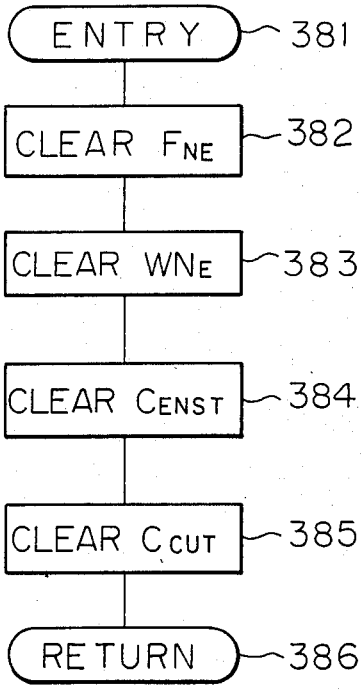
FIGS. 3 and 4A and 4B are flow diagrams illustrating the operation of the control circuit of FIG. 1.

In FIG. 3, which represents an initial routine, an entry step 381 is started by, for example, the turning on of the ignition switch (not shown). Then, at steps 382, 383, 384, and 385, $F_{NE}$, $WN_E$, $C_{ENST}$, and $C_{CUT}$, respectively, are cleared and control is transferred to step 386, thereby completing the routine of FIG. 3.

$F_{NE}$ is a flag indicating that the rotational angle sensor 234 is in an abnormal state.

$WN_E$ is engine speed data based upon the output of the rotational angle sensor 234.

$C_{ENST}$ is a timing counter value for monitoring a state where there is no output of the rotational angle sensor 234.

$C_{CUT}$ is a timing counter value for monitoring a delay time period for the fuel-cutting operation.

Figure 4A:
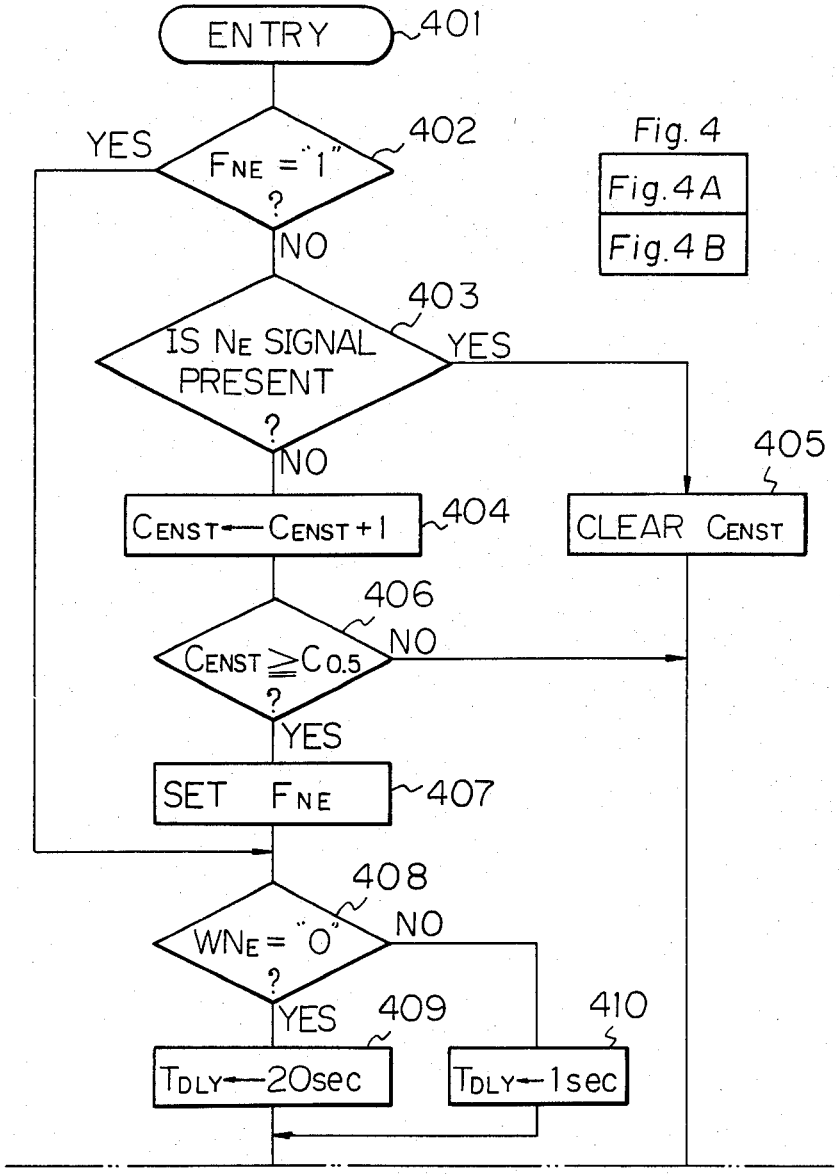
Figure 4B:
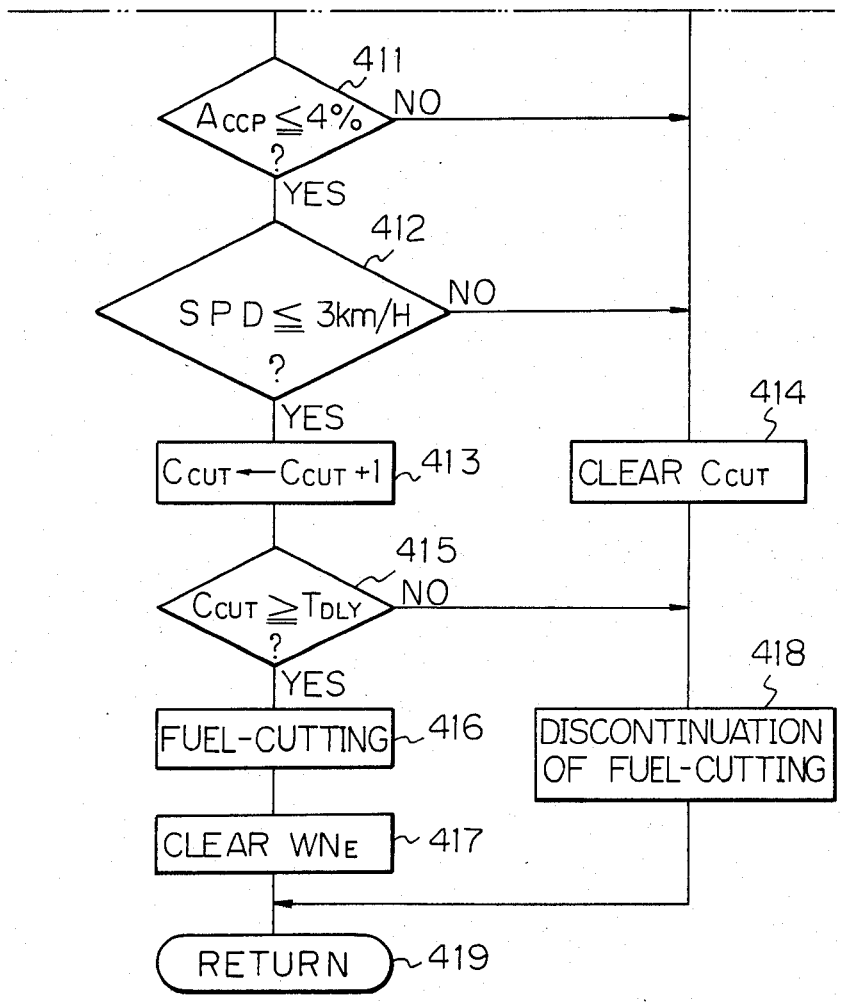

The flow chart as illustrated in FIG. 4 is a time-interrupt routine executed at every predetermined time period, such as 4 msec. When control is transferred from the entry step 401 to step 402, the CPU 310 determines whether or not $F_{NE}$="1"Z. Since the flag $F_{NE}$ is cleared by the initial routine of FIG. 3, control is transferred to step 403.

At steps 403, 404, 405, and 406, the CPU 310 monitors whether or not an elapsed time period amounts to a predetermined time period, such as 0.5 sec, when the $N_E$ signal of the rotational angle sensor 234 is not present. In more detail, at step 403, the CPU 310 detects whether or not the $N_E$ signal of the rotational angle sensor 234 is present. If the $N_E$ signal is not present, control is transferred to step 404, in which the timing counter value $C_{ENST}$ is counted up by +1, which corresponds to 4 msec. Then at step 406 the CPU 310 determines whether or not $C_{ENST} \geqq C_{0.5}$, where $C_{0.5}$ corresponds to 0.5 sec. If the determination at step 406 is YES, control is transferred to step 407, in which the flag $F_{NE}$ is set.

On the contrary, if the $N_E$ signal is present, control is transferred from step 403 to step 405, in which the timing counter value $C_{ENST}$ is cleared, and is then transferred to step 414. If the determination at step 406 is NO, control is transferred to step 414. Thus, before the timing counter value $C_{ENST}$ reaches $C_{0.5}$, one appearance of the $N_E$ signal clears the value $C_{ENST}$.

Control flow of step 407 reaches step 408. At step 408, the CPU 310 determines whether or not $WN_E=0$, i.e., whether or not the engine 10 is re-cranking. That is, $WN_E \neq 0$ means that the rotational angle sensor 234 is in an abnormal state during rotation of the engine 10 while $WN_E=0$ means that the engine 10 is re-cranking after the rotational angle sensor 234 assumes an abnormal state.

At steps 409 and 410, a delay time period $T_{DLY}$ for a fuel-cutting operation is set. That is, if $WN_E \neq 0$ at step 408, the delay time period $T_{DLY}$ is a relatively small value, such as 1 sec, at step 410 while if $W_{NE}=0$ at step 408, the delay time period $T_{DLY}$ is a relatively large value, such as 20 sec.

At steps 411 and 412, the CPU 310 determines whether or not the vehicle is in an approximately stopped state. In more detail, at step 411, the CPU 310 detects whether or not the accelerator opening $A_{CCP}$ is approximately zero, i.e., $A_{CCP} \leqq 4\%$, and at step 412, the CPU 310 detects whether or not the vehicle speed SPD is approximately zero, i.e., SPD $\leqq$ 3 km/H.

If the determinations at steps 411 and 412 are both affirmative, control is transferred to steps 413 and 415, in which the above-mentioned delay time period $T_{DLY}$ is monitored. That is, at step 413, the timing counter value $C_{CUT}$ is counted up by +1, which corresponds to 4 msec. Then at step 415, the CPU 310 determines whether or not $C_{CUT} \geqq T_{DLY}$.

At step 413, if $C_{CUT} \geqq T_{DLY}$, control is transferred to step 416, in which a fuel-cutting operation is performed, i.e., the fuel-cutting valve 236 is closed. In addition, at step 417, the engine-speed data $WN_E$ stored in the RAM 312 is cleared so as to indicate that the next starting of the engine 10 will be a re-cranked starting.

On the contrary, at step 414, the timing counter value $C_{CUT}$ is cleared. That is, once a fuel-cutting operation is performed, a monitoring operation for the delay time period is also performed from $C_{CUT}=0$.

At step 418, an operation to discontinue fuel-cutting, i.e., a fuel-supplying operation, is performed.

Note that once it has been established that the rotational angle sensor 234 is in an abnormal state, control flows from step 402 directly to step 408 since the flag $F_{NE}$ is "1".

Figure 5:
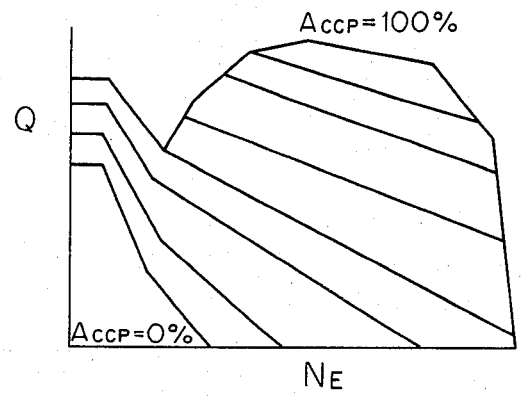
FIGS. 5 and 6 are diagrams illustrating the fuel-injection amount characteristics.
Figure 6:
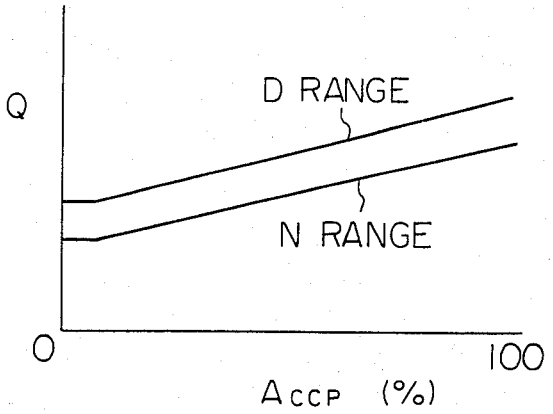

In FIG. 5, which illustrates the fuel-injection-amount characteristics when the rotational angle sensor 234 is in a normal state, a base fuel-injection amount Q is calculated dependent upon the engine speed $N_E$ and the accelerator opening $A_{CCP}$. In this case, when the accelerator opening is relatively small, the fuel-injection amount rapidly decreases as the engine speed $N_E$ increases. On the contrary, in FIG. 6, which illustrates the fuel-injection amount characteristics when the rotational angle sensor 234 is in an abnormal state, a base fuel-injection amount is calculated dependent upon only the accelerator opening $A_{CCP}$. For example, when the rotational angle sensor 234 assumes an abnormal state during the D range mode, the fuel-injection amount is larger than that during the N range mode. According to the present invention, when the rotational angle sensor 234 assumes an abnormal state, a fuel-cutting operation is performed in a relatively short time period so as to indicate to the driver that an abnormal state where the fuel-injection amount is large exists, thereby reducing his anxiety. In addition, after the driver is made aware of such an abnormal state, it is possible to depress the brake pedal to restart the engine. Further, after the engine is restarted, even when the accelerator opening is approximately zero and the vehicle speed is approximately zero, the delay time period for a fuel-cutting operation is relatively large. As a result, stalling of the engine is prevented and the driver can easily drive the vehicle onto the shoulder of the road.

We claim:

1. A method for controlling the fuel-injection amount in a diesel engine having a rotational angle sensor for detecting the engine speed, comprising the steps of:

detecting whether said rotational angle sensor is in an abnormal state;

detecting whether said engine is being recranked when said rotational angle sensor is in an abnormal state;

determining a delay time period for delaying cranking of the engine, the delay time period being determined longer during re-cranking than during initial cranking;

detecting whether the accelerator opening is smaller than a predetermined opening;

detecting whether the vehicle speed of a vehicle in which said engine is disposed is less than a predetermined speed;

detecting whether an elapsed time period is equal to said determined delay time period while said accelerator opening is smaller than said predetermined opening and the vehicle speed is less than said predetermined speed; and performing a fuel-cutting operation when said elapsed time period is equal to said determined delay time period.

2. A method as set forth in claim 1, wherein said step of detecting whether the rotational angle sensor is in an abnormal state includes the steps of:

detecting whether an output signal of said rotational angle sensor is being output; and detecting whether an elapsed time period is equal to a predetermined time period when the output signal of said rotational angle sensor is not being output.

3. An apparatus for controlling the fuel-injection amount in a diesel engine powering a vehicle having an accelerator comprising:

rotational angle sensor means for detecting rotational engine speed;

means for detecting whether said rotational angle sensor means is functioning in an abnormal state;

means for detecting whether said engine is being re-cranked while said rotational angle sensor means is functioning in said abnormal state;

means for determining a delay time period for delaying cranking of said engine such that the delay time period during re-cranking is longer than that during non-re-cranking;

means for detecting whether the accelerator opening is smaller than a predetermined opening;

means for detecting whether the vehicle speed of said vehicle is less than a predetermined speed;

means for detecting whether an elapsed time period is equal to said determined delay time period while said accelerator opening is smaller than said predetermined opening and said vehicle speed is less than said predetermined speed; and means for performing a fuel-cutting operation when said elapsed time period is equal to said determined delay time period.

4. An apparatus set forth in claim 3, wherein said means for detecting whether the rotational angle sensor means is functioning in an abnormal state includes:

means for detecting whether said rotational angle sensor means is putting out an output signal; and means for detecting whether an elapsed time period is equal to a predetermined time period while no output signal is being put out by said rotational angle sensor means.

* * * * *